US007204244B1

(12) United States Patent
Pedersen

(10) Patent No.: US 7,204,244 B1
(45) Date of Patent: Apr. 17, 2007

(54) DIAMOND CORE DRILL BIT

(75) Inventor: Lyle Dean Pedersen, Omaha, NE (US)

(73) Assignee: Luminare Supply Corporation, Omaha, NE (US)

( * ) Notice: Subject to any disclaimer, the term of this patent is extended or adjusted under 35 U.S.C. 154(b) by 0 days.

(21) Appl. No.: 11/307,998

(22) Filed: Mar. 2, 2006

(51) Int. Cl.
*B28D 1/14* (2006.01)

(52) U.S. Cl. ..... 125/20; 451/548

(58) Field of Classification Search ..... 451/548, 451/541, 550; 125/20
See application file for complete search history.

(56) References Cited

U.S. PATENT DOCUMENTS

| | | | | | |
|---|---|---|---|---|---|
| 3,243,924 | A | * | 4/1966 | Peters | 451/488 |
| 3,382,743 | A | * | 5/1968 | Trevathan | 408/145 |
| 3,494,348 | A | * | 2/1970 | Lindblad | 125/20 |
| 3,495,359 | A | * | 2/1970 | Phaal et al. | 451/540 |
| 3,640,027 | A | | 2/1972 | Weiss | 51/206 |
| 4,274,769 | A | | 6/1981 | Multakh | 408/145 |
| 4,610,579 | A | | 9/1986 | Frank et al. | 408/60 |
| 4,911,253 | A | | 3/1990 | Cliche | 175/213 |
| 5,009,553 | A | | 4/1991 | Nowman | 408/1 R |
| 5,069,584 | A | | 12/1991 | Obermeier et al. | 408/145 |
| 5,392,759 | A | | 2/1995 | Kwang | 125/15 |
| 5,393,175 | A | | 2/1995 | Courville | 408/56 |
| 5,996,571 | A | | 12/1999 | Jedick | 125/20 |
| 6,033,295 | A | | 3/2000 | Fisher et al. | 451/540 |
| 6,192,875 | B1 | | 2/2001 | Koroku et al. | 125/20 |
| 6,277,016 | B1 | | 8/2001 | Koide | 451/541 |
| 6,382,202 | B2 | | 5/2002 | Chau-Ngoc et al. | 125/20 |

FOREIGN PATENT DOCUMENTS

| | | | | |
|---|---|---|---|---|
| FR | 1006588 | * | 4/1952 | 125/20 |
| GB | 935030 | * | 8/1963 | 451/548 |
| JP | 5-200728 | * | 8/1993 | 125/20 |

* cited by examiner

*Primary Examiner*—Robert A. Rose
(74) *Attorney, Agent, or Firm*—Louis Ventre, Jr.

(57) ABSTRACT

A diamond core drill bit (100) is disclosed. The drill bit has a right-circular cylindrical body (120) with at least one side lubrication hole (122) toward the bottom of the body and a plurality of parallel grooves (124) oriented in an axial direction at the bottom circumferential sidewall of the body. A cap (130) at the top of the cylindrical body (120) closes one end of the body. The cap has a central lubrication hole (134) and alternative embodiments have at least one core extraction hole (132). These holes extend through the cap to the interior of the body. A hollow drive shaft (140) is mated to the cap (130) over the central lubrication hole (134), such that a lubricant can flow through the hollow shaft and into the internal volume of the body and out a side lubrication hole (122). Diamond grit (160) is bonded around the bottom edge on a portion of the internal and external sidewall surfaces at the bottom circumferential edge of the body (120) in such a way that the diamond grit (160) is bonded over a portion of the axial height of the grooves (124).

12 Claims, 2 Drawing Sheets

DIAMOND CORE DRILL BIT

FIELD OF INVENTION

In the field of tools for penetrating hard materials, such as tile, stone, glass, ceramics and porcelain, the invention relates to a rotatable diamond drill bit having a core-receiving central portion.

BACKGROUND OF THE INVENTION

Very hard materials such as glass, stone, tile, ceramic and porcelain, generally cannot be drilled with standard steel or carbide bits because of the extreme hardness of the material. One solution is to bond diamonds (or other extremely hard materials) onto the tip of a specially designed drill bit, allowing the diamonds to perform the actual cutting process. Diamonds are extremely hard and provide a durable cutting edge.

Several drawbacks are attendant to the use of diamonds on drill bits. The more diamonds that are bonded to the cutting edge, the longer the life of the bit. However, additional diamond layers have less bond strength and result in a thicker cut in the work piece. In addition, during use, two primary forces act upon the diamond cutting edge and the bond: 1) the physical force of the cutting action, and 2) heat caused by friction. Because of the hardness of diamonds, the most limiting factor in diamond drill bit life is generally the destruction of the bond structure that holds the diamonds onto the drill bit tip. The diamonds don't normally wear out; they break off or fall off as the drilling forces and heat overcome the bond.

It is an object of the invention to provide a means to extend the life of the drill bit by increasing the quantity of diamonds on the cutting edge while minimizing their thickness. It is further an object of the present invention to maximize the bond strength while minimizing the shear forces acting on bonds holding the diamonds to the sidewalls of the drill bit. And, it is further an object of the present invention to reduce the heat generated by friction of the cutting action.

The present invention incorporates a unique combination of features that provide optimal drilling efficiency in both natural and man made materials. The invention incorporates simple and efficient means for (1) minimizing waste in the cut material with an overall bit design that enables the use of a thin-walled drill bit; (2) improving diamond quantity and bond strength on the bit's cutting edge to lengthen the life of the bit; (3) lubricating the cutting surface from the inside of the bit using center lubricant feed system to improve the cut; (4) removing cutting debris from the inside of the bit to reduce cutting time and heat generation; (5) obtaining a smooth bore in the drilled material to improve quality; and (6) removing the core from the drill bit when the cut is finished to reduce time to completion.

DESCRIPTION OF PRIOR ART

The prior art in this field is extensive, but does not teach grooved sidewall bonding. The prior art does not suggest all the elements of the invention, nor does it teach combining the elements to produce a single diamond core bit of simple construction and improved efficiency.

Typical of impregnated diamond drill bits, U.S. Pat. No. 4,274,769 to Leonid Multakh on Jun. 23, 1981 employs diamonds impregnated in a metal matrix in the cutting surface. It does not teach improved bonding of diamond grit over a grooved sidewall extending from the cutting edge, as in the present invention. The '769 patent teaches layers of diamond grit. It does not teach or enable diamond grit in substantially simpler bit construction.

Prior art teaches the general shape of a diamond core drill to bore or cut hard articles. For example, U.S. Pat. No. 5,392,759 to Kim S. Kwang on Feb. 28, 1995 discloses a cup-shaped tool body; an annular diamond blade portion fixedly attached to the upper circumferential edge of the cup-shaped tool body; and a shaft formed at the center of lower surface of the cup-shaped tool body, which is to be coupled to a power transmission shaft. However, in order to achieve cutting efficiency, cooling and lubrication at the cutting surface, and chip removal, the '759 invention teaches a plurality of cuts or serrations in the cutting edge of the diamond blade portion, which are evenly spaced around the circumference.

In contrast, the '759 features complicate the construction of the bit and are rendered unnecessary in the present invention. The present invention employs a smooth cutting edge with no serrations required for cooling, lubrication and chip removal. A hollow drive shaft creates the means to flow lubrication to the internal volume of the cylindrical body, which reduces cutting friction, cools the drill bit and work piece and removes cutting debris. Chip removal is accomplished by flow of the lubricant through the central lubrication hole onto the grinding region on the work piece and then out the side lubrication hole. Finally, lubrication on the outside of the bit is improved by churn induced by vertical grooves at the bottom circumferential sidewall of the cylindrical body.

In its more simplistic embodiments, prior art teaches diamond grit bonded in a matrix to the periphery of the work-drilling end. However, these lack the efficiency improvements of the present invention. For example, U.S. Pat. No. 5,009,553 to William G. Nowman on Apr. 23, 1991 discloses a drill bit for "hardplate" of the type commonly employed in burglar-resistant safes. The hollow interior of the lower end of the drill bit is filled with a beeswax core to prevent clogging the drill bit. However, such simplistic prior art does not disclose axial grooves on the sidewall surface of the drill extending to the cutting edge to improve diamond bonding, lubrication efficiency and drill bit lifetime. Missing are the efficiency improvements added in the present invention by internal lubrication flow through a shaft hole, and a side hole in the drill body for cutting efficiency, cooling and particle removal with the lubricant.

The prior art teaches the use of grooves in drills, but not in the same way or for the same purpose as in the present invention. For example, U.S. Pat. No. 5,069,584 to Josef Obermeier, et al. on Dec. 3, 1991 is for a hollow drilling tool having grooves around a portion of its circumference. The grooves in the '584 patent serve to permit drainage of coolant water and of the drillings or drilled material rinsed away by the water. The '584 grooves are not suitable for accomplishing the same purpose in the present invention, that is, of adding area to enhance attachment of the diamond grit to the edge and reduce shear forces on the bond. Rather the '584 grooves are for drainage of the coolant and removal of the drillings and are generally located above the diamonds, not underneath the diamonds. The location of the '584 grooves make them inapplicable to the purpose of the grooves in the present invention. Further, the '584 disclosure teaches a need for slots in the cutting edge to permit the passage of water. The present invention does not employ slots or segments in the cutting edge. The present invention is a much simpler drill to manufacture and use and its grooves serve different purposes.

Accordingly, the present invention will serve to improve the prior art by delivering a drill bit that is easy to manufacture, uncomplicated in its use, and efficient in achieving its purpose. Its unique combination of features permit minimizing waste in the cut material, improving bit life with an improved diamond bonding surface; enhancing delivery of lubrication to the cutting surface, removal of cutting debris from the cutting edge, obtaining a smooth bore in the drilled material; and removing the core from the drill bit.

BRIEF SUMMARY OF THE INVENTION

The invention is a diamond core drill bit. The drill bit has a right-circular cylindrical body. The body has at least one side lubrication hole, but preferably two at opposite sides of the body, and toward the bottom of the body. The body has a plurality of parallel grooves oriented in an axial direction extending from at least one of the two bottom circumferential sidewalls of the body. A cap at the top of the cylindrical body closes one end of the body. The cap has a central lubrication hole. In alternative embodiments, the cap has least one core extraction hole, but preferably three core extraction holes. These holes extend through the cap to the interior of the body. A hollow drive shaft is mated to the cap over the central lubrication hole, such that lubricant can flow through the hollow shaft and into the internal volume of the body and out a side lubrication hole. Diamond grit is electroplate-bonded around the bottom edge on a portion of the internal and external sidewall surfaces at the bottom circumferential edge of the body in such a way that the diamond grit is bonded over a portion of the axial height of the grooves.

BRIEF DESCRIPTION OF THE DRAWINGS

The drawings depict the preferred embodiment of the invention.

DETAILED DESCRIPTION

The preferred embodiment of the diamond core drill bit is shown in the figures and is described herein. This detailed description focuses on the preferred embodiment. While some alternative embodiments are noted herein, the detailed description is not intended to limit the invention, which is defined by the claims.

Figure 1:
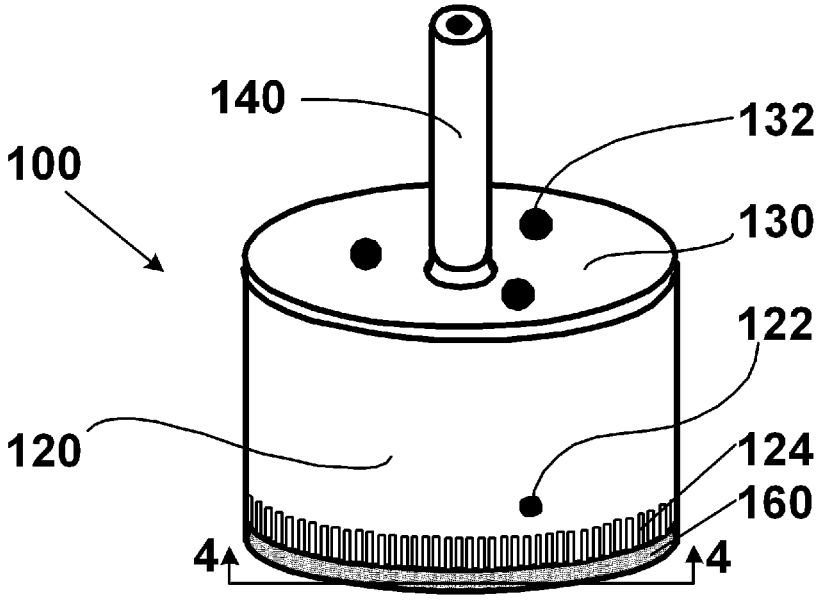
FIG. 1 is a perspective of the diamond core drill bit.

FIG. 1 shows a perspective of the diamond core drill bit (100). The drill bit (100) could be made in any size desired for drilling, but in the preferred embodiment would have a drilling diameter of about 3 inches or less and an overall height of about 3 inches or less. The drill bit need not be coated, but preferably would have a nickel plating to inhibit rust, to reduce friction, and to present a clean, shiny, and silvery appearance.

The drill bit (100) has a body (120) that is in the form of a right-circular cylinder. The body (120) is typically made of steel, but any sturdy material commonly used for such bits, such as titanium, aluminum, copper, brass, etc., may be used for the body. The body (120) preferably has at least one side lubrication hole (122), but typically would have two side lubrication holes at opposite sides of the body. Any such lubrication hole (122) is preferably located toward the bottom of the body so that the lubrication, coolant flow and cutting debris from inside the body can flow to the outside of the body after having made contact with the cutting surface. Each side lubrication hole (122) is preferably located immediately above a plurality of parallel grooves (124) in one or both sidewalls of the body (120).

The grooves (124) preferably are located around the body (120) equidistant from each other. The grooves are preferably, about three eights of an inch in height. The grooves (124) are oriented in an axial direction and extend from at least one of the two bottom circumferential sidewalls of the body, that is, they extend on either the outside wall or the inside wall or both walls. Axial grooves are beneficial to both the outside and inside bonded cutting edge, but may be located on only the outside bonded sidewall or the inside bonded sidewall when the body has a thin wall and stability of the bit would be compromised by grooves on both sides.

Figure 4:
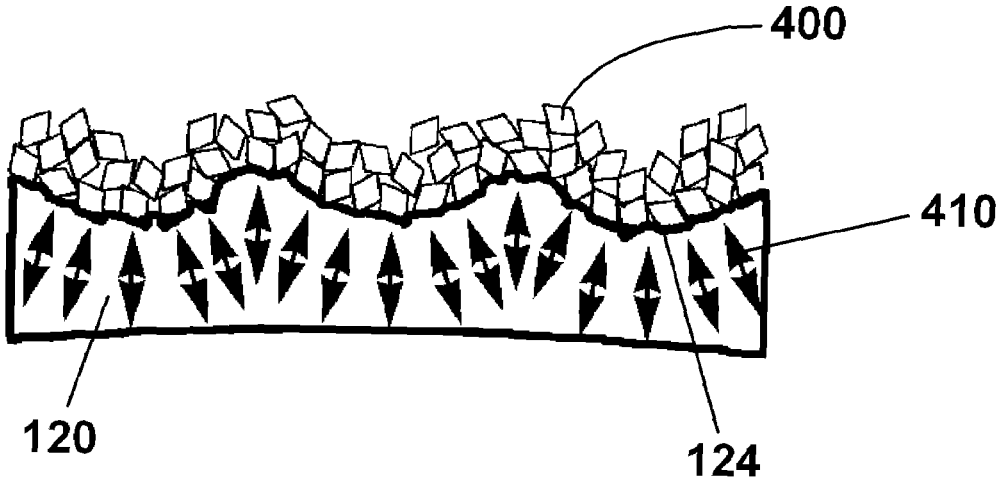
FIG. 4 is a sectional view of the wall showing diamonds bonded over the grooves.

FIG. 4 shows the grooves (124), which serve four primary functions: the grooves (124) increase the bonding surface area; they provide multi-directional diamond bonding to the sidewall; they convert shear stresses on the bond to compressive and tensile stresses; and they improve cooling of the bit and the work piece being cut.

The grooves (124) in a sidewall provide an uneven, wave-like bonding surface. This wave-like bonding surface increases the area for diamond bonding relative to the smooth surface area of an ungrooved sidewall. This increased surface area attributable to the grooves allows more diamonds to bond to the sidewall without adding additional layers. The increased quantity of diamonds results in longer bit life, compared with a bit having an ungrooved sidewall.

The uneven, wave-like bonding surface from the grooves also enable a variety of multi-directional bonding force vectors as indicated by the arrows (410) between the body and the diamonds (400). The multi-directional bonding force vectors strengthen the bond of the diamonds to the body because the grooves allow the tensile and compressive strength of the bond, which are the bonds of greatest strength, to occur from multiple directions. For the smooth, ungrooved surface, the bonding force is uni-directional and perpendicular to the cutting circle. Improved bond strength from multi-directional bonding results in longer drill bit life and improves the quality of the cut.

The grooves reduce shear forces acting to separate the diamonds from the sidewall of the drill bit during cutting. During use, the cutting action creates a shear force in the direction of a line tangential to the circumference of the bit. Thus, an ungroved drill bit sidewall enables a shear force to be applied at a right angle to the bond. In contrast, the grooved drill bit, as shown in FIG. 4, converts some of the shear force vector to compressive force vectors wherein the grooved walls reduce the forces acting on the bond between the diamonds and the sidewall. The grooves effectively reduce the shear force acting on the bonded surface and convert a component of the shear force to a compressive force on the sidewall. Reduced shear force applied to the bond during the cutting process results in slower breakdown of the bond and longer drill bit life.

The wave-like surface of the diamonds in the grooves (124) increases lubricant churn around at the cutting surface, which lowers the temperature of the bit during cutting and enhances cutting efficiency. Extending the grooves above the bonded diamond surface creates additional uneven surface near the tip. The uneven surface creates turbulence and churns the lubricant as the drill bit spins, increasing lubrication flow to the drill bit tip. Better lubrication and cooling reduces the destructive heat force, resulting in extended drill bit life. The increased lubricant flow and increased turbulence of the lubricant also improves the clearance of cut material debris from the cutting edge. This improves cutting speed and efficiency. Better debris removal also promotes increased lubrication and cooling at the tip.

The above-described benefit of grooves applies to any cutting drill bit, whether a coring or a solid drill bit, employing any type of bonded abrasive cutting materials. Examples of other bonded abrasive cutting materials used in the art are cubic boron nitride, aluminum oxide and carbide tungsten.

Figure 2:
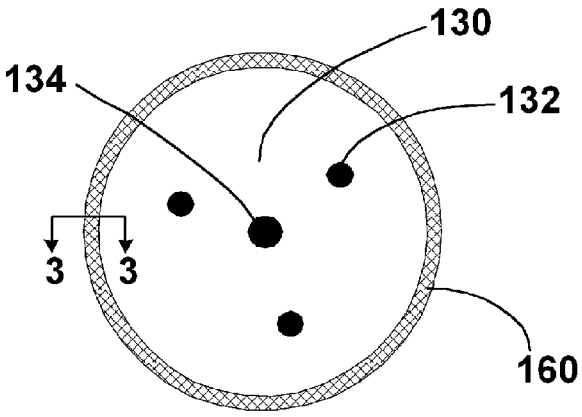
FIG. 2 is a bottom view of the diamond core drill bit.

A cap (130) affixed to the top of the cylindrical body (120) essentially provides a reinforcing closure of that end of the body. Preferably, the closure is not complete as there are holes as shown in FIGS. 1 and 2 (132, 134) extending through the cap (130) to the interior of the body. The holes may be any diameter that fits on the cap, but preferably are about one-eighth of an inch in diameter. The cap (130) has a central lubrication hole (134). In alternative embodiments, the cap also has at least one core extraction hole (132), but preferably three core extraction holes.

The central lubrication hole (134) enables the provision of lubricant to the inside of the body during cutting. The lubricant reduces friction, cools the work piece at the cutting edge, and removes cutting debris that would otherwise interfere with the cutting and lubrication functions. When lubricant flow through the central lubrication hole (134) is employed, each side lubrication hole (122) allows excess lubricant to exit, providing lubrication, cooling and debris removal to the outside of the bit. However, provision of lubricant through the central lubrication hole (134) is optional.

In some applications, a work piece in which a hole is being drilled may be underwater or otherwise in a coolant bath. In these applications, lubricant flow through the central lubrication hole (134) is not needed. In these applications, each side lubrication hole (122) allows fluid to flow into and out of the center of the bit, providing lubrication, cooling and debris removal. In other applications, dry drilling may be employed.

Each core extraction hole (132) provides a convenient means to enable the removal of the cores or plugs that result from the drilling operation. A screwdriver, nail or other rod-like tool is inserted into a core extraction hole (132) to quickly and easily dislodge the core and remove it from the drill bit.

A hollow drive shaft (140) is mated to the cap (130), preferably over the central lubrication hole (134), such that lubricant can flow through the hollow shaft (140) and into the internal volume of the body (120) and out each side lubrication hole (122). The drive shaft is typically made of the same material as the body (120). The preferred outside diameter of the drive shaft (140) is convenient to common drill chucks, for example three-eights or one-half inches. The preferred inside diameter of the drive shaft (140) matches the size of any central lubrication hole (134) and is preferably about one-eighth of an inch. The drive shaft (140) may be any height, but preferably would be about an inch or two long. Longer drive shafts are appropriate when access to the material being drilled requires a long shaft.

Diamond grit (160) is bonded, preferably electroplate-bonded, around the bottom circumferential edge of the body on a portion of the internal and external sidewalls of the body in such a way that the diamond grit (160) is bonded over a portion of the axial height of the grooves (124). Hardened synthetic resin or other bonding material may also be used. The diamond grit (160) would typically be about three or four tenths of a millimeter or less in thickness and would rise about three-sixteenths of an inch from the bottom edge on both the inside and outside wall of the body (120). The diamond grit (160) would typically cover about half of the axial length of the grooves (124).

Figure 3:
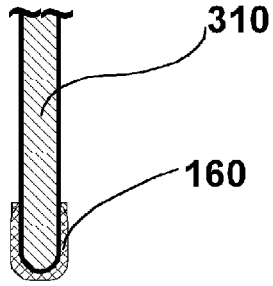
FIG. 3 is a sectional view showing a lower portion of the wall of the diamond core drill bit.

FIG. 2 shows a bottom view of the drill bit looking into the body and showing the diamond grit (160) on the periphery and holes (132, 134) in the cap (130). A section (3—3) of the wall of the body is further shown in FIG. 3. The body preferably has a wall (310), which is relatively thin in thickness. When drilling or cutting very hard materials, it is highly beneficial to reduce the thickness of the cutting edge. A typical wall (310) thickness is approximately one-half millimeter or less. A thin wall thickness is enabled in this drill bit design and is preferable because it reduces waste in the material being cut and enables fast and efficient drilling of hard materials.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

What is claimed is:

1. A diamond core drill bit comprising, a nickel-plated body in the form of a right-circular cylinder and having a plurality of grooves creating an uneven, wave-like bonding surface, said grooves being parallel to each other and axial in height extending from at least one bottom circumferential sidewall of the body;

diamond grit bonded around the bottom circumferential edge of the body on a portion of the internal and external sidewalls wherein the diamond grit is bonded over a portion of the axial height of the grooves so as to create multi-directional bonding forces between the diamonds and the bonding surface;

a nickel-plated cap at the top of the body having a central lubrication hole; and, a nickel-plated hollow shaft mated to the cap over the central lubrication hole wherein a lubricant can flow through the hollow shaft and into the internal volume of the body and out the side lubrication hole.

2. The diamond core drill bit of claim 1 wherein the body has a drilling diameter of about three inches or less.

3. The diamond core drill bit of claim 1 wherein the axial height of the grooves is about three eights of an inch in height.

4. The diamond core drill bit of claim 1 wherein the body has at least one side lubrication hole toward the bottom of the body.

5. The diamond core drill bit of claim 1 wherein the cap has at least one core extraction hole.

6. The diamond core drill bit of claim 1 wherein the cap has three core extraction holes.

7. The diamond core drill bit of claim 1 wherein the hollow shaft is three-eighths inches or less in outside diameter.

8. The diamond core drill bit of claim 1 wherein the hollow shaft is one-half inches or less in outside diameter.

9. The diamond core drill bit of claim 1 wherein the body has a wall thickness of about one-half millimeter.

10. The diamond core drill bit of claim 1 wherein the diamond grit is bonded by an electro-plating process.

11. The diamond core drill bit of claim 1 wherein the diamond grit is bonded by a hardened synthetic resin.

12. The diamond core drill bit of claim 1 wherein the diamond grit is about four tenths of a millimeter or less in thickness and rises about three-sixteenths of an inch from the bottom edge on both the inside and outside wall of the body.

* * * * *